United States Patent [19]

Mattscheck et al.

[11] Patent Number: 4,676,025

[45] Date of Patent: Jun. 30, 1987

[54] REMOTELY ACTIVATABLE SEAL

[75] Inventors: Douglas Mattscheck, Monroe, N.Y.; David E. Rogers, Lehigh, Pa.

[73] Assignee: Schlegel Corporation, Rochester, N.Y.

[21] Appl. No.: 815,570

[22] Filed: Jan. 2, 1986

[51] Int. Cl.[4] ..... E06B 7/16

[52] U.S. Cl. ..... 49/477; 52/232; 220/232; 169/48; 169/61

[58] Field of Search ..... 49/475, 477, 504, 498; 52/232, 173 R; 374/187; 360/500; 169/48, 61; 220/232; 277/26, 22

[56] References Cited

U.S. PATENT DOCUMENTS

| | | | |
|---|---|---|---|
| 3,566,541 | 3/1971 | Coulter | 49/475 |
| 3,747,275 | 7/1973 | May et al. | 49/477 |
| 3,936,661 | 2/1976 | Furuishi et al. | 219/528 |
| 3,964,214 | 6/1976 | Wendt | 52/232 |
| 4,045,930 | 9/1977 | Dixon | 52/232 |
| 4,073,521 | 2/1978 | Mena | 49/477 |
| 4,115,609 | 9/1978 | Denman | 428/68 |
| 4,150,509 | 4/1979 | Knap | 49/477 |
| 4,307,543 | 12/1981 | Schulthess | 52/232 |
| 4,320,611 | 3/1982 | Freeman | 52/309.1 |
| 4,323,607 | 4/1982 | Nishimura et al. | 219/213 |
| 4,364,210 | 12/1982 | Fleming et al. | 52/221 |
| 4,399,317 | 8/1983 | Van Dyk | 49/477 |
| 4,467,577 | 8/1984 | Licht | 52/232 |

FOREIGN PATENT DOCUMENTS

| | | | |
|---|---|---|---|
| 1186498 | 5/1985 | Canada . | |
| 63948 | 10/1955 | France | 49/477 |
| 2092214A | 8/1982 | United Kingdom . | |
| 2106972A | 4/1983 | United Kingdom . | |

*Primary Examiner*—Kenneth Downey
*Assistant Examiner*—Gerald A. Anderson
*Attorney, Agent, or Firm*—Steele, Gould & Fried

[57] ABSTRACT

An improved fire seal comprises: an elongated flexible carrier incorporating structure for affixing the seal in a gap between opposing surfaces; a resilient cellular core; a bead of intumescent material; a flexible outer protective liner covering the cellular core and the intumescent bead; and, a remotely actuatable heat source disposed in the seal for activating the intumescent material responsive to a remotely generated signal, whereby the gap may be sealed by expansion of the intumescent material responsive to an alarm condition in a location remote from the gap. A system for sealing gaps in doorways, windows and the like comprises: a plurality of fire seals as described, affixed in gaps of the doorways, windows and the like; a plurality of detectors for sensing alarm conditions; a signal generator for activating the intumescent material responsive to alarm conditions sensed by any of the plurality of detectors; and, a controller for the signal generator, for selectively activating the intumescent material responsive to sequences in detection of alarm conditions by any of the plurality of detectors, whereby the gaps may be effectively sealed against penetration of smoke, noxious gases and the like prior to fire-like ambient conditions adjacent the gaps.

19 Claims, 11 Drawing Figures

REMOTELY ACTIVATABLE SEAL

BACKGROUND OF THE INVENTION

1. Field of the Invention

This invention relates to the field of seals incorporating intumescent material, which expand under thermal stress, to seal gaps in doorways, windows and the like to prevent passage or penetration of smoke, noxious fumes and the like. More particularly, this invention relates to an improved fire seal wherein the intumescent material may be selectively activated responsive to remotely sensed alarm conditions, for example, wherein a fire detected in any room of a structure may result in every single window and doorway in the structure being sealed.

2. Prior Art

Intumescent materials are those which swell or expand upon continued exposure to fire or heat. Typical intumescent materials comprise a fire retardant composition having an intumescent component, such as hydrated alkali metal silicate in granular form, an organic binder component, organic char-forming components such as a phenolic resin, and fillers. An example of such a material sold in sheet form is "Fire Barrier Sheet FS-195" available from the 3M Company. These sheets remain in their flexible, unexpanded state under normal conditions, but when subjected to temperatures on the order of 110°·C. and higher, readily intumesce up to ten times their original volume to form a rigid char and thereby seal a gap against the passage of fire, heat, smoke, vapors and water. Such a char is strong, highly refractory, and is not easily blown out of a gap when subjected to water hose pressure. Other intumescent materials include "Palusol" sold by BASAF and "Expantrol" sold by the 3M Company. In will be appreciated that the particular form of intumescent material utilized in this invention does not form a part of the invention in and of itself. Of course, certain types may prove most beneficial in different circumstances. Accordingly, the chemical composition and characteristics of such intumescent materials need not be considered herein in detail.

The prior art has recognized that intumescent material may be incorporated into weather stripping and other kinds of seals normally used for doorways and windows. A reservoir of intumescent material is provided along the weather strip or seal, and in the event of fire-like ambient conditions adjacent the doorways or windows, the intumescent material will expand out of the reservoir and, theoretically, seal the gap against penetration of smoke, noxious fumes and the like. The following patent references are typical of sealing strips known in the art which incorporate intumescent material for fire-sealing purposes.

United Kingdom published Application No. GB 2 106 972 A—Dixon discloses a retrofit door seal incorporating intumescent material in a pocket separate from the weather seal. The intumescent material is not held, formed or mounted integrally with the conventional door seal portion of the seal. The intumescent material responds only to ambient conditions, and there is no suggestion that it can or should be remotely activated.

United Kingdom published Patent Application No. GB 2 092 214 A—Schroders discloses a door seal wherein a reservoir of intumescent material is integral with the structure forming the conventional portion of the door seal, but as in Dixon above, there is no suggestion that the intumescent material can or should be remotely activated.

U.S. Pat. No. 4,364,210—Fleming, et al. discloses a fire and smoke resistant construction for sealing a penetration of a passageway through a fire-resistant wall, floor, partition or the like. The construction includes an insert of intumescent material mounted at one end of the penetration and adapted to expand and fill the penetration when heated to its activation temperature. In accordance with an alternative embodiment, an end cap formed of plastic laminated intumescent material is provided, through which wires, cables or the like may be passed. The end cap seals the penetration at low ambient temperatures. There is no suggestion that the intumescent material can or should be remotely activated.

There is another class of products in which intentional activation of a thermally sensitive material is effected, although none are known to be in the context of fire seals. The following references are typical of manipulating thermoplastic materials.

U.S. Pat. No. 3,936,661—Furuishi, et al. discloses an electrothermally deformable leveling pad, includjng one or more plate members made of thermoplastic material, and at least one electric heater adjacent one surface of the plate member. The structure is employed for leveling heavy structural elements, such as railroad rails. Upon heating, the thermoplastic layer softens slightly and becomes compressible under load. When the heating element is turned off, the material hardens and becomes stable at a thickness which is less than its original thickness. There is no suggestion that the electrothermal activation system used by Furuishi, et al. could or should be used for remotely activating intumescent material in weather stripping, fire seals and the like.

U.S. Pat. No. 4,115,609—Denman discloses a sealing element which is useful, inter alia, in mounting automobile windshields. The structure is similar in theory to that of Furuishi, et al., in that it includes an elongated body of a butyl or ethylene-propylene rubber composition, rather than a body intumescent material. Denman does teach that a heating element can be embedded in the thermoplastic material, for softening the material. However, the rubber material does not expand upon heating, but rather, changes from a resilient state to a plastically deformable, but otherwise stable state. Upon cooling, the strip retains the shape into which it was forced during heating by the load presented by those members joined by the strip. There is no suggestion that a heating element can or should be embedded in an intumescent material forming part of a weather strip or fire seal, to enable remote activation of the intumescent material.

Finally, U.S. Pat. No. 4,323,607—Nishimura, et al. discloses a heat-shrinkable cover for sealing the joint between two pipes or the like. The heat-shrinkable cover has heating wires or cables embedded therein, the wires being oriented in a direction so as not to interfere with shrinkage of the cover. There is no suggestion that such a heating system can or should be employed with intumescent material forming part of a weather strip or fire seal.

Although it is apparently known in the art to form weather strips or fire seals with reservoirs of intumescent material, and although it is known to use electrothermal systems for heating and shaping thermoplastic materials, it has apparently not occurred to those skilled in either of these disparate arts to provide a fire seal having a reservoir of intumescent material, together with means for remotely activating the intumescent material responsive to detection of alarm conditions remote from the fire seal. Those skilled in the respective arts have apparently also failed to appreciate that such remotely activatable fire seals can be incorporated into comprehensive fire or gas protection systems. This invention is primarily directed to remotely activatable fire and gas seals and fire and gas protection systems incorporating such remotely activatable seals.

Other references which may be of interest, insofar as they relate generally to fire seals and useful compositions of intumescent materials, but which nevertheless fail to even suggest the invention taught herein, are U.S. Pats. Nos. 4,045,930—Dixon; 4,320,611—Freeman; 4,467,577—Licht; and, 4,468,043—Brazel.

As may well be appreciated, as useful as known fire seals may be in preventing passage or penetration of smoke and noxious fumes through doorways and windows, it is often too late by the time the gaps in such structures are sealed. It is important to realize that closing gaps cannot only prevent damage or injury, but in many instances, can reduce the flow of oxygen to a fire, and so retard expansion of the fire from its starting point. The ambient temperatures necessary to activate typical intumescent materials are such that one immediately on the other side of a doorway, for example, in which the intumescent material is activated, is already in significant danger from smoke and noxious fumes. It is also quite conceivable, for example, that one might wish to delay activation of intumescent seals until after a building or a portion of a building has been evacuated, in order that subsequent opening and closing of the doorways will not destroy the fire seals. Fire, smoke and gas control systems according to this invention, incorporating seals having remotely activatable intumescent reservoirs, are easily incorporated into automatically and manually controlled systems, as well as hybrids, and particularly computer controlled systems. The advantages of remotely activatable expandable seals have apparently escaped those skilled in the art. The invention taught herein indeed fills a significant gap in available fire, smoke and gas control systems.

SUMMARY OF THE INVENTION

It is an object of this invention to provide an improved fire and gas seals.

It is another object of this invention to provide improved seals incorporating intumescent material.

It is another object of this invention to provide improved fire and gas seals incorporating remotely activatable intumescent material for sealing and securing gaps in doorways, windows and the like prior to immediately adjacent fire conditions.

It is yet another object of this invention to provide a smoke, gas and fume control system utilizing a plurality of remotely activatable seals, the remotely activatable seals incorporating remotely activatable intumescent material.

It is yet another object of this invention to provide such systems with control means for selectively activating the intumescent material responsive to sequences in detection of alarm conditions by any of a plurality of detectors.

These and other objects are accomplished by an improved fire seal, and the like, comprising: an elongated flexible carrier incorporating means for affixing the seal in a gap between opposing surfaces; a resilient cellular core; a bead of intumescent material; a flexible outer protective layer covering the cellular core and the intumescent bead; and, means disposed in the seal for activating the intumescent material responsive to a remotely generated signal, whereby the gap may be sealed by expansion of the intumescent material responsive to an alarm condition in a location remote from the gap. The seal may further comprise a semi-rigid insert for enhancing longitudinal stability and for directionally controlling expansion of the intumescent material.

These and other objects of the invention are also accomplished by a system for sealing gaps in doorways, windows and the like, comprising: resilient seals affixed in gaps of the doorways, windows and the like, the seals having longitudinal beads of intumescent material and means for activating the intumescent material responsive to a remotely generated signals; a plurality of detectors for sensing alarm conditions; means for generating the signals to activate the intumescent material responsive to the detectors; and, control means for the signal generating means, for selectively activating the intumescent material responsive to sequences in detection of alarm conditions by any of the plurality of detectors, whereby the gaps may be effectively sealed against penetration of smoke, noxious gases and the like prior to fire-like ambient conditions adjacent the gaps. The system may further comprise an independent power source, and the seals may incorporate means for directionally controlling expansion of the intumescent material.

These and other objects will become apparent upon consideration of the detailed description of the preferred embodiments, which are illustrated in the accompanying drawings.

BRIEF DESCRIPTION OF THE DRAWINGS

Presently preferred embodiments of the invention are shown in the accompanying drawings, it being understood that the invention is not limited to the precise arrangements and instrumentalities shown.

DETAILED DESCRIPTION OF THE PREFERRED EMBODIMENTS

Figure 1:
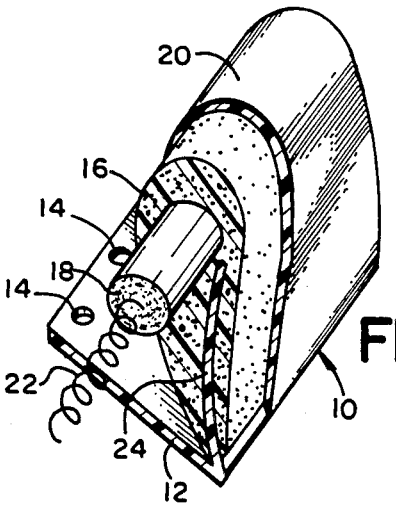
FIG. 1 is a perspective view, progressively cut away, of a section of a fire seal according to this invention.

A seal 10 according to this invention is shown in FIG. 1. In many respects, the seal according to this invention is similar to a conventional door seal or weather strip, in that, in most instances, the seal must function as a typical weather strip or door seal in the absence of a fire or alarm conditions.

The seal 10 comprises an elongated flexible carrier 12 incorporating means for affixing the seal in a gap between opposing surfaces. In the illustrated embodiment, the flexible carrier 12 is provided with a plurality of apertures 14 by which the carrier may be nailed, tacked or screwed into position. Alternatively, the carrier may be provided with an appropriate cross-section for sliding engagement into a track of corresponding shape and size, as might be expected in storm window and sliding window structure. As a further alternative, the flexible carrier 12 may have an adhesive layer on the under surface thereof, which layer is protected by a release strip prior to use. Although a variety of methods and means are available for affixing the seal in position, the means should not be such as would readily fail under fire or fire-like conditions, that is, very high ambient temperatures.

The seal 10 further comprises a resilient cellular core 16, which provides the expected and conventional resilient sealing characteristics of a conventional door seal, window seal or weather strip in general.

The seal 10 also comprises a bead of intumescent material 18 running through, or adjacent to, or coextensive with the resilient cellular core 16. The bead of intumescent material 18 forms an indefinitely extending longitudinal reservoir of intumescent material. The bead of intumescent material forms a remotely activatable substantially expandable means for sealing gaps. In the presently preferred embodiments, both the resilient cellular core 16 and the bead of intumescent material 18 are covered by a flexible outer protective liner 20.

Figure 2:
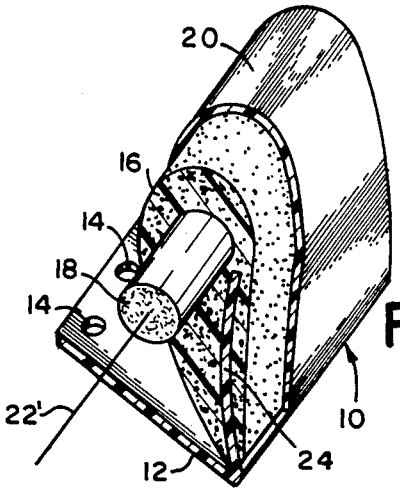
FIG. 2 is a perspective view, progressively cut away, of an alternative embodiment of a fire seal according to this invention.
Figure 6:
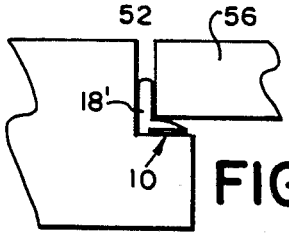
Figure 7:
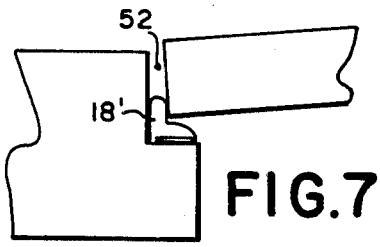
Figure 9:
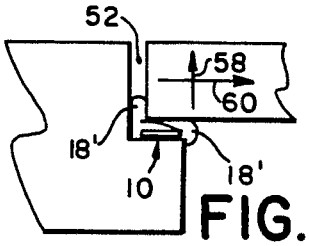

In accordance with the principal objects of this invention, and of most importance in all embodiments, the seal 10 comprises means for activating the intumescent material responsive to a remotely generated signal. In the embodiment illustrated in FIG. 1, the means for activating the intumescent material responsive to a remotely generated signal comprises a helically wound or coiled wire 22 disposed substantially interiorly of the bead of intumescent material 18. Wire 22 is a high resistance electrically conductive wire, which attains a high temperature, and which generates heat when sufficient current passes therethrough. Sufficient heat has been generated from a helically wound 28 gauge nichrome wire, or from a straight or uncoiled length of 32 gauge nichrome wire, the 32 gauge wire having a higher resistivity. A straight wire embodiment is shown in FIG. 2. Wires of higher resistivity can be expected to generate more heat for a given electrical current running therethrough. The amount of current is largely a function of how quickly the activating temperature is to be reached. Ideally, the wire will reach the activating temperature within a range of power or current levels which include those driven by a mains supply at the upper end of the range or an auxiliary generator or battery supply at the lower end of the range. Current or power levels will also depend on the amount or length of intumescent material which must be activated. In the absence of specifying all such system parameters, specific amperage or current levels cannot be set forth. Even so, such levels can be determined by those skilled in the art based upon the consideration noted herein. Accordingly, the particular temperature reached is not critical, except that it must be sufficiently high, and must be maintained for a sufficiently long period of time, for the liner 20 to melt or otherwise degrade and for the intumescent material to completely expand so as to seal a gap in a doorway, a window or the like. Such expansion is illustrated in FIGS. 6, 7 and 9. The wire 22 may alternatively be wound around the perimeter of the bead of intumescent material, or may run as a substantially straight wire either through or immediately adjacent the perimeter of the intumescent bead.

Figure 3:
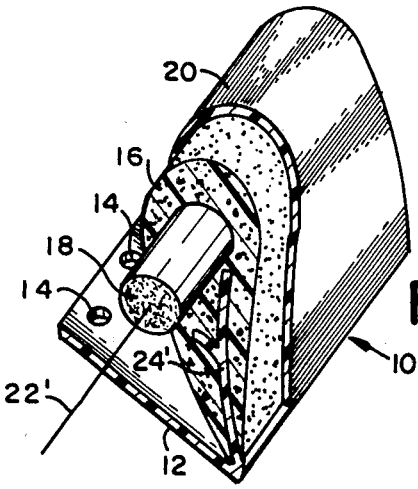
FIG. 3 is a perspective view, progressively cut away, of a further embodiment of a fire seal according to this invention.

The seal 10 may also further comprise a semi-rigid insert 24 for enhancing longitudinal stability. The semi-rigid insert may be formed integrally with the carrier 12. The semi-rigid insert 24 may constitute means for directionally controlling expansion of the intumescent material, depending upon its shape, position and dimension. In the presently preferred embodiment, the semi-rigid insert does in fact constitute such a means for controlling expansion. The semi-rigid insert 24 may be disposed interiorly of the protective liner 20, or may form a portion thereof, depending upon the geometrical considerations of the particular gap to be sealed. A further alternative embodiment to the seal shown in FIGS. 1 and 2 is shown in FIG. 3. Seal 10' has a semi-rigid insert 24 which inhibits expansion of the intumescent material along two directions.

Figure 4:
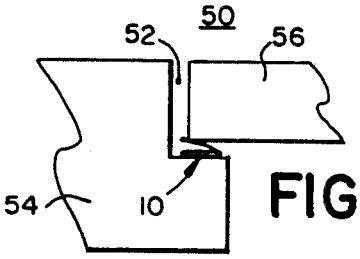
FIGS. 4–9 are diagrammatic illustrations of gaps in doorways, illustrating problems encountered in sealing such gaps, and solutions for such problems.
Figure 5:
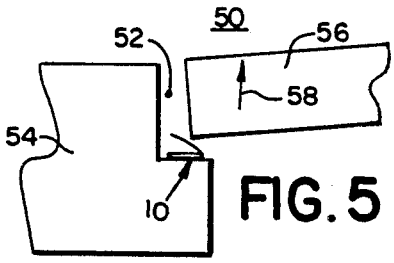
Figure 8:
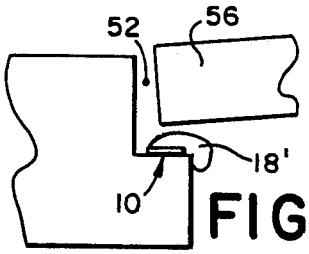

FIGS. 4 through 9 diagrammatically illustrate a portion of a doorway 50 in which a gap 52 is defined between a doorjamb 54 and the edge of a door 56. A seal 10 according to this invention is affixed in or on the doorjamb 54. For purposes of clarity, the seal 10 is illustrated essentially by a line drawing. FIG. 4 illustrates how the gap 52 is sealed under normal ambient conditions. The resilient portion of the seal is simply compressed. In the case of a fire, however, it is known that all doors will bow, in the direction of arrow 58, particularly as ambient temperatures reach and exceed 1,000° F. With regard to the orientation of FIGS. 4–9, the width of the vertical leg of the L-shaped gap 52 is not substantially affected by bowing of the door, as can be appreciated by comparing FIGS. 4 and 5. However, the width of the shorter, horizontal leg of the L-shaped gap 52 is substantially increased, by factors of at least two or three times. FIG. 6 illustrates the manner in which the intumescent material can expand into the gap 52, expanded intumescent material being designated by reference numeral 18', before the door 56 bows away from the doorjamb. As long as the intumescent material is directed upwardly into the vertical leg of the L-shaped gap, the gap will remain sealed by the expanded intumescent material 18', even if the door bows thereafter, as shown in FIG. 7. If the intumescent material expands after the door has bowed, and is not directed during expansion, or if it is directed toward the horizontal leg of the L-shaped gap, then upon bowing of the door 56, the gap will become unsealed, as shown in FIG. 8. Proper placement of the semi-rigid insert and proper placement of the intumescent material can result in the material expanding into both legs of the L-shaped gap, as shown in FIG. 9. In this instance, the gap will be protected whether the edge of the door tends to move in the direction of arrow 58, or in the direction of arrow 60. It will be appreciated that, in most instances, adequate sealing of the gap will more likely be accomplished if the intumescent material undergoes expansion prior to bowing or other displacement of the door. This enables the door and doorjamb to act as the walls of a mold cavity which, in conjunction with the structure within the seal, assures that the intumescent material will expand optimally. The only way to be certain that the intumescent material will expand prior to dislocation of the door, is for the material to be remotely activated prior to ambient fire or fire-like conditions immediately adjacent the doorway. It will also be appreciated that windows and other similar structures will undergo similar kinds of deformations under fire or fire-like ambient conditions, and the same considerations will apply.

Remotely activatable seals according to this invention may form the basis for a complete system for sealing gaps in doorways, windows and the like. Such a system 100 is illustrated in block diagram form in FIG. 10. The heart of the system 100 is a central processor 102, which may be a substantially hard-wired circuit of discrete components, or may be a small computer which functions according to a software program, or according to a more limited program burned into a read only memory. The system comprises a plurality of detectors 104, which are designated D1, D2 . . . , D8. The detectors 104 may be smoke detectors, thermal sensors, gas sniffers or the like. Sealing gaps in doorways, windows and the like is useful not only under high temperature fire conditions, but also very useful in sealing against the passage or escape of noxious fumes from accidental gas leaks in the absence of a fire. The central processor 102 controls a signal generator 106, which includes means for generating a signal capable of activating the intumescent material in any or all of the seals. The signal generator 106 is in turn connected to three doorway seals, designated DW1, DW2 and DW3, as well as five window seals, designated W1, W2 . . . , W5.

The dotted lines running from the signal generator 106 to DW2 and DW3 are illustrative of the alternative manner in which the seals can be connected to the signal generator. Wires 22 in the seals can be connected to the control system in a number of ways, including terminal blocks adjacent ends of the seals and/or soldering pads formed directly on the seals, for example on the carrier portions thereof. Such connections must withstand the activating temperature, at least until the intumescent material has expanded. It is possible to put any number of seals on a single bus or connecting line, such that each will be activated simultaneously under all circumstances. As a further alternative, it is possible to separately connect each of the seals to the signal generator, so that the capability to remotely activate the seals independently of one another is maintained. Alternatively, it is also possible to connect each of the seals to a common power bus, and to provide a switch for selectively connecting each of the seals to the power bus in accordance with operation of the signal generator and the central processor. It is also possible to connect any number of detectors on a common bus or input to the central processor 102. It will be appreciated that the number of detectors and seals depicted in FIG. 10 is arbitrary, insofar as a system according to the invention can be adapted to control greater or fewer numbers of detectors and seals.

The system may be provided with a control panel 112 connected to the central processor, as well as a display 114. Display 114 is likely to be connected to both the central processor 102 and the control panel 112. For purposes of enhancing reliability during emergency conditions, the system may be provided with an independent power source 116, for example batteries or a generator. The independent power source may energize only the control aspects of the system, or only the seal activation aspects of the system, or both. A suitable control system may be constructed from components of a Power Line Communication System as manufactured by the Controls Division of Butler Manufacturing Company. Such a system, as described in Document 080-40158, Revised May, 1984, includes an output converter, transmitters, receivers, transceivers, multiplex transmitters and transponders. Receivers include relays which can switch on power to activatable seals.

Figure 10:
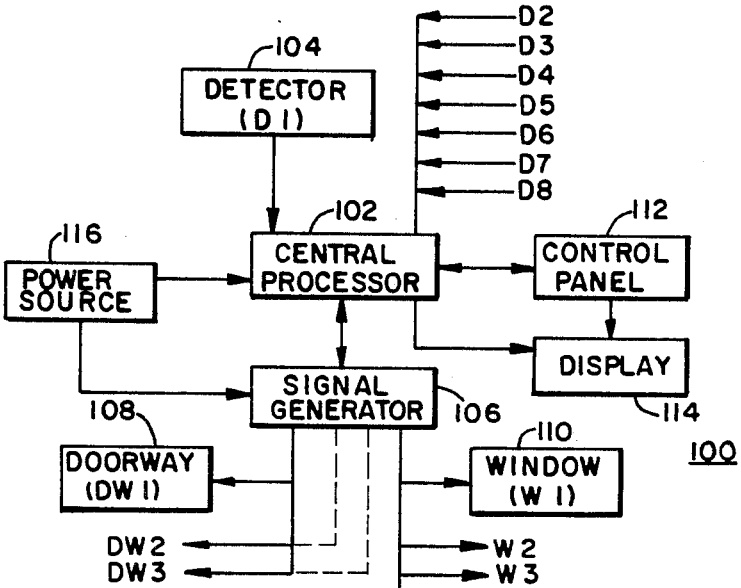
FIG. 10 is a block diagram of a system for controlling the passage of smoke, noxious fumes and the like through gaps in a structure, according to this invention.
Figure 11:
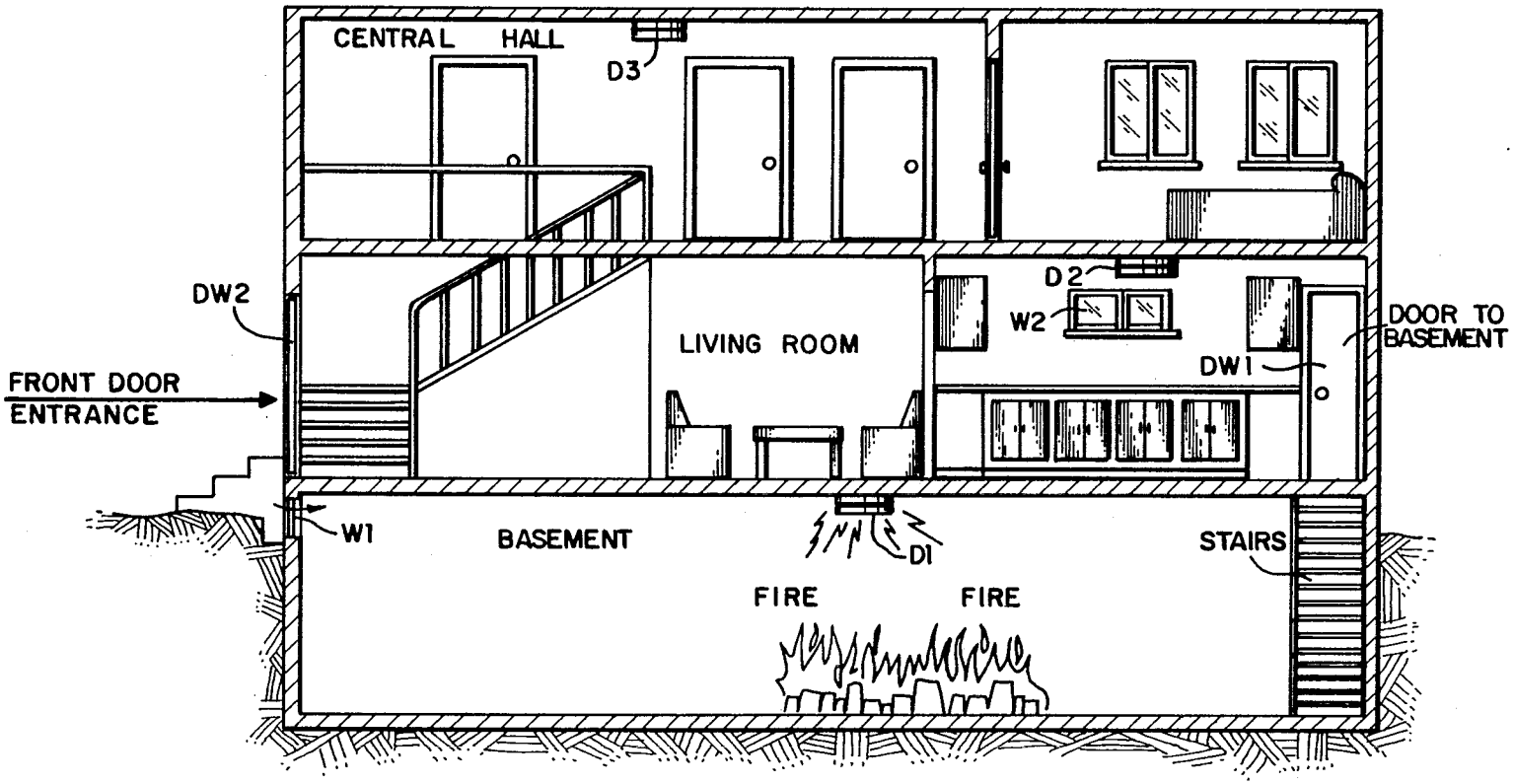
FIG. 11 is a diagrammatic illustration of a house incorporating the system illustrated in FIG. 10.

FIG. 11 is a diagrammatic illustration of a typical home incorporating a protective system according to that shown in FIG. 10. For purposes of simplification, there are three detectors, D1 located in the basement, D2 located in the kitchen and D3 located in the upstairs hallway. There are two windows protected by seals according to this invention, a basement window W1 and kitchen window W2. Two doorways are protected by seals according to this system, the door between the kitchen and the basement DW1 and the front door DW2. In this instance, a fire is indicated as having started in the basement, and the detector D1 is not only sending a signal to the central processor, but is sounding an audible alarm as well. It will be appreciated that smoke and perhaps noxious fumes are likely to pour out of the gaps in the kitchen/basement door and into the house before ambient conditions adjacent the basement-/kitchen door are hot enough to directly activate the intumescent material. Accordingly, the house is quite likely to fill with smoke before appropriate fire seals are activated. At the same time, it is also likely that air (and therefore oxygen) will be drawn into the basement through the gaps around window W1, fanning the fire. This would be the case in the absence of this invention. However, the system may easily be programmed to remotely activate seals W1, DW1 and W2 responsive to detection of the alarm condition, namely fire, by detector D1 in the basement. This will effectively block fresh air from fanning the fire, perhaps entering through window W1 or doorway DW1, and will at the same time prevent smoke and any other noxious fumes from passing from the basement into the kitchen, and from the kitchen into the rest of the house. Having been alerted by the audible alarm, or perhaps by a the central alarm activated by the central processor responsive to sensing of an alarm condition by detector D1, a family can safely exit from the bedrooms on the second floor of the home without fear of encountering smoke and other noxious fumes. Moreover, the safe evacuation of the house can be accomplished prior to direct activation of detectors D2 and D3, by which time a fully safe evacuation might well be impossible.

This invention, both seals and systems incorporating such seals, have been described primarily in terms of sealing gaps in doorways and windows, and in terms of being fire seals. It will be appreciated by those skilled in the art that seals can be constructed in accordance with this invention which are effective to seal ducts in ventilation systems, wall penetrations, machinery housings and a large number of other such applications. It is in this context that the invention is described in the claims as being applicable to sealing gaps in doorways, windows and the like. It will also be appreciated that seals according to this invention are particularly useful for containing noxious or poisonous gases within rooms, suites of rooms, wings and entire buildings wherein accidental leaks might occur, completely apart from concern for fire and smoke.

This invention may be embodied in other specific forms without departing from the spirit or essential attributes thereof. Accordingly, reference should be made to the appended claims, rather than the foregoing specification, as indicating the scope of the invention.

What is claimed is:

1. An improved expandable seal, comprising:
an elongated flexible carrier incorporating means for affixing a seal in a gap between opposing surfaces;
a resilient cellular core;
a bead of intumescent material coextensive with the cellular core;
a flexible outer protective liner covering the cellular core and the intumescent material; and,
means disposed in the seal for activating the intumescent material responsive to a remotely generated signal, whereby the gap may be sealed by expansion of the intumescent material responsive to an alarm condition at a location remote from the gap.

2. The seal of claim 1, further comprising a semi-rigid insert for enhancing longitudinal stability of the seal.

3. The seal of claim 1, further comprising means for directionally controlling expansion of the intumescent material.

4. The seal of claim 1, further comprising a semi-rigid insert for enhancing longitudinal stability of the seal, the insert being so dimensioned and positioned to directionally control expansion of the intumescent material.

5. The seal of claim 1, wherein the activating means is disposed interiorly of the cellular core.

6. The seal of claim 1, wherein the activating means is disposed interiorly of the intumescent bead.

7. The seal of claim 1, wherein the activating means is a high resistance wire which generates sufficient heat to melt the outer liner and to activate the intumescent material when an electric current passes through the wire.

8. The seal of claim 6, wherein the activating means is a high resistance wire which generates sufficient heat to melt the outer liner and to activate the intumescent material when an electric current passes through the wire.

9. The seal of claim 8, wherein the activating means is a helical wire.

10. The seal of claim 9, further comprising means for directionally controlling expansion of the intumescent material.

11. A system for sealing gaps in doorways, windows and the like, comprising:
a plurality of seals affixed in gaps in doorways, windows and the like, the seals having longitudinally extending beads of intumescent material for sealing the gaps and means for activating the intumescent material responsive to a remotely generated signal;
at least one detector for sensing an alarm condition; and,
means for generating the signal to activate the intumescent material responsive to the at least one detector, whereby the gaps may be effectively sealed against penetration of smoke, noxious gases and the like in the absence of fire-like ambient conditions adjacent to the gaps.

12. The system of claim 11, comprising:
a plurality of detectors for sensing alarm conditions; and,
control means for the signal generating means, for selectively activating the intumescent material responsive to sequences in detection of alarm conditions by any of the plurality of detectors.

13. The system of claim 11, further comprising an independent power source.

14. The system of claim 12, further comprising an independent power source.

15. The system of claim 11, wherein:
the means for activating the intumescent material comprises high resistance wires embedded in the intumescent material; and,
the signal generating means supplies electrical current through the wires to melt the outer liner and heat, and thereby activate, the intumescent material.

16. The system of claim 14, wherein:
the means for activating the intumescent material comprises high resistance wires embedded in the intumescent material; and,
the signal generating means supplies electrical current through the wires to melt the outer liner and heat, and thereby activate, the intumescent material.

17. The system of claim 16, wherein the activating means comprises a helical wire.

18. The system of claim 15, wherein the seals further comprise means for directionally controlling expansion of the intumescent material.

19. An improved expandable seal, comprising;
an elongated carrier;
a bead of intumescent material disposed on the carrier in an unexpanded condition; and,
means for activating the intumescent material responsive to a remotely generated signal, whereby a gap may be sealed against penetration of gases and smoke responsive to an alarm condition at a location remote from the gap.

* * * * *